US012672685B2

(12) United States Patent
Shaw

(10) Patent No.: US 12,672,685 B2
(45) Date of Patent: Jul. 7, 2026

(54) CUMMERBUND TENSIONING SYSTEM

(71) Applicant: Hithem Shaw, Opelika, AL (US)

(72) Inventor: Hithem Shaw, Opelika, AL (US)

(73) Assignee: Shaw Concepts LLC

( * ) Notice: Subject to any disclaimer, the term of this patent is extended or adjusted under 35 U.S.C. 154(b) by 152 days.

(21) Appl. No.: 18/646,851

(22) Filed: Apr. 26, 2024

(65) Prior Publication Data

US 2024/0358099 A1 Oct. 31, 2024

Related U.S. Application Data

(60) Provisional application No. 63/461,918, filed on Apr. 26, 2023.

(51) Int. Cl.

*A41D 13/00* (2006.01)
*A41D 13/05* (2006.01)
*F41H 1/02* (2006.01)

(52) U.S. Cl.

CPC ..... *A41D 13/0562* (2013.01); *F41H 1/02* (2013.01); *A41D 2300/32* (2013.01); *A41D 2300/332* (2013.01)

(58) Field of Classification Search

CPC ..... A41D 13/0562; A41D 13/0531; A41D 2300/33; A41D 13/0506; A41D 13/0518; F41H 1/02; Y10T 24/21; Y10T 24/2183; Y10T 24/2187; A43C 11/165; A63B 2071/1208; A61F 5/01; A61F 5/03; A61F 5/02; A61F 5/022; A61F 5/028

USPC .... 2/317, 318, 321, 323, 325, 326, 329, 330

See application file for complete search history.

(56) References Cited

U.S. PATENT DOCUMENTS

| | | | | |
|---|---|---|---|---|
| 1,736,128 | A * | 11/1929 | Pease | A61F 5/03 450/122 |
| 8,490,212 | B1 | 7/2013 | Asher et al. | |
| 9,101,181 | B2 | 8/2015 | Soderberg et al. | |
| 10,492,568 | B2 | 12/2019 | Burns et al. | |
| 2007/0128959 | A1* | 6/2007 | Cooke | B63C 9/08 441/108 |
| 2011/0112448 | A1* | 5/2011 | Wu | A61H 7/006 2/418 |
| 2012/0004587 | A1* | 1/2012 | Nickel | A61F 5/028 602/5 |
| 2017/0296902 | A1* | 10/2017 | Kim | A63B 69/32 |
| 2020/0253315 | A1* | 8/2020 | Maloney | A42B 3/142 |
| 2021/0196000 | A1* | 7/2021 | Trudel | A43C 7/08 |

* cited by examiner

*Primary Examiner* — Jack W Lavinder

(74) *Attorney, Agent, or Firm* — Asgaard Patent Services, LLC; F. Wayne Thompson, Jr.

(57) ABSTRACT

Disclosed is a cummerbund tensioning system configured to join opposing ends of a cummerbund to the rear plate bag of a plate carrier and to adjust the fit of the cummerbund. An example cummerbund tensioning system includes a mounting panel, a tensioning device, a plurality of adapters, and a lace. The lace operably connects the tensioning device to both the mounting panel and the plurality of adapters. The plurality of adapters, in conjunction with the lace, are configured to join a first opposing end and a second opposing end of the cummerbund to the mounting panel. The tensioning device is configured to adjust the fit of the cummerbund by gathering the lace, which draws the opposing ends closer together and tightens the cummerbund around a wearer.

18 Claims, 5 Drawing Sheets

CUMMERBUND TENSIONING SYSTEM

CROSS-REFERENCE TO RELATED APPLICATION(S)

This application claims the benefit of U.S. Provisional Application Ser. No. 63/461,918, filed on Apr. 26, 2023, the entirety of which is incorporated herein by reference.

TECHNICAL FIELD

This disclosure relates to a cummerbund tensioning system for plate carriers.

BACKGROUND

Plate carriers are typically equipped with a cummerbund that wraps around the torso to provide support and, in some instances, additional ballistic protection. However, achieving a balance between ease of donning and a secure fit can be a challenge. Although there are currently a number of mechanisms and methods for adjusting the fit of a cummerbund about the torso of a wearer, there remains a need for improved fit adjustment devices.

Accordingly, there exists a need for the cummerbund tensioning system disclosed herein. It is to the provision of a cummerbund tensioning system configured to address these needs, and others, that the present invention is primarily directed.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a cummerbund tensioning system configured to join opposing ends of a cummerbund to the rear plate bag of a plate carrier and to adjust the fit of the cummerbund.

In one example implementation, a cummerbund tensioning system comprises a mounting panel, a tensioning device, a plurality of adapters, a first elastic cord, a second elastic cord, and a lace. The lace operably connects the tensioning device to both the mounting panel and the plurality of adapters. The plurality of adapters, in conjunction with the lace, are configured to join a first end and a second end opposite the first end of the cummerbund to the mounting panel. The first elastic cord secures at least two adapters of the plurality of adapters to the first end of the cummerbund, and the second elastic cord secures at least two adapters of the plurality of adapters to the second end opposite the first end of the cummerbund. The tensioning device is configured to adjust the fit of the cummerbund by gathering the lace, thereby drawing the first and second ends closer together and tightening the cummerbund around a wearer.

In another example implementation, a cummerbund tensioning system comprises a mounting panel, a tensioning device, a plurality of adapters, a first elastic cord, a second elastic cord, and a lace. The tensioning device is attached to the mounting panel. The mounting panel includes a plurality of spaced-apart openings positioned to route the lace. The lace is routed through the spaced-apart openings of the mounting panel and operably connects the tensioning device to the plurality of adapters. The plurality of adapters, in conjunction with the lace, are configured to join a first end and a second end opposite the first end of the cummerbund to the mounting panel. The first elastic cord secures at least two adapters of the plurality of adapters to the first end of the cummerbund, and the second elastic cord secures at least two adapters of the plurality of adapters to the second end opposite the first end of the cummerbund. The tensioning device is configured to adjust the fit of the cummerbund by gathering the lace, thereby drawing the first and second ends closer together and tightening the cummerbund around a wearer.

In yet another example implementation, a cummerbund tensioning system comprises a mounting panel, a tensioning device, a plurality of adapters, a first elastic cord, a second elastic cord, and a lace. The tensioning device is attached to the mounting panel. The mounting panel is configured for attachment to a back panel section of a plate carrier and includes a plurality of spaced-apart openings positioned to route the lace. The lace is routed through the spaced-apart openings of the mounting panel and operably connects the tensioning device to the plurality of adapters. The plurality of adapters, in conjunction with the lace, are configured to join a first end and a second end opposite the first end of the cummerbund to the mounting panel. The first elastic cord secures at least two adapters of the plurality of adapters to the first end of the cummerbund, and the second elastic cord secures at least two adapters of the plurality of adapters to the second end opposite the first end of the cummerbund. The tensioning device is configured to adjust the fit of the cummerbund by gathering the lace, thereby drawing the first and second ends closer together and tightening the cummerbund around a wearer.

BRIEF DESCRIPTION OF THE DRAWINGS

Like reference numerals refer to corresponding parts throughout the several views of the drawings.

DETAILED DESCRIPTION

Figure 1:
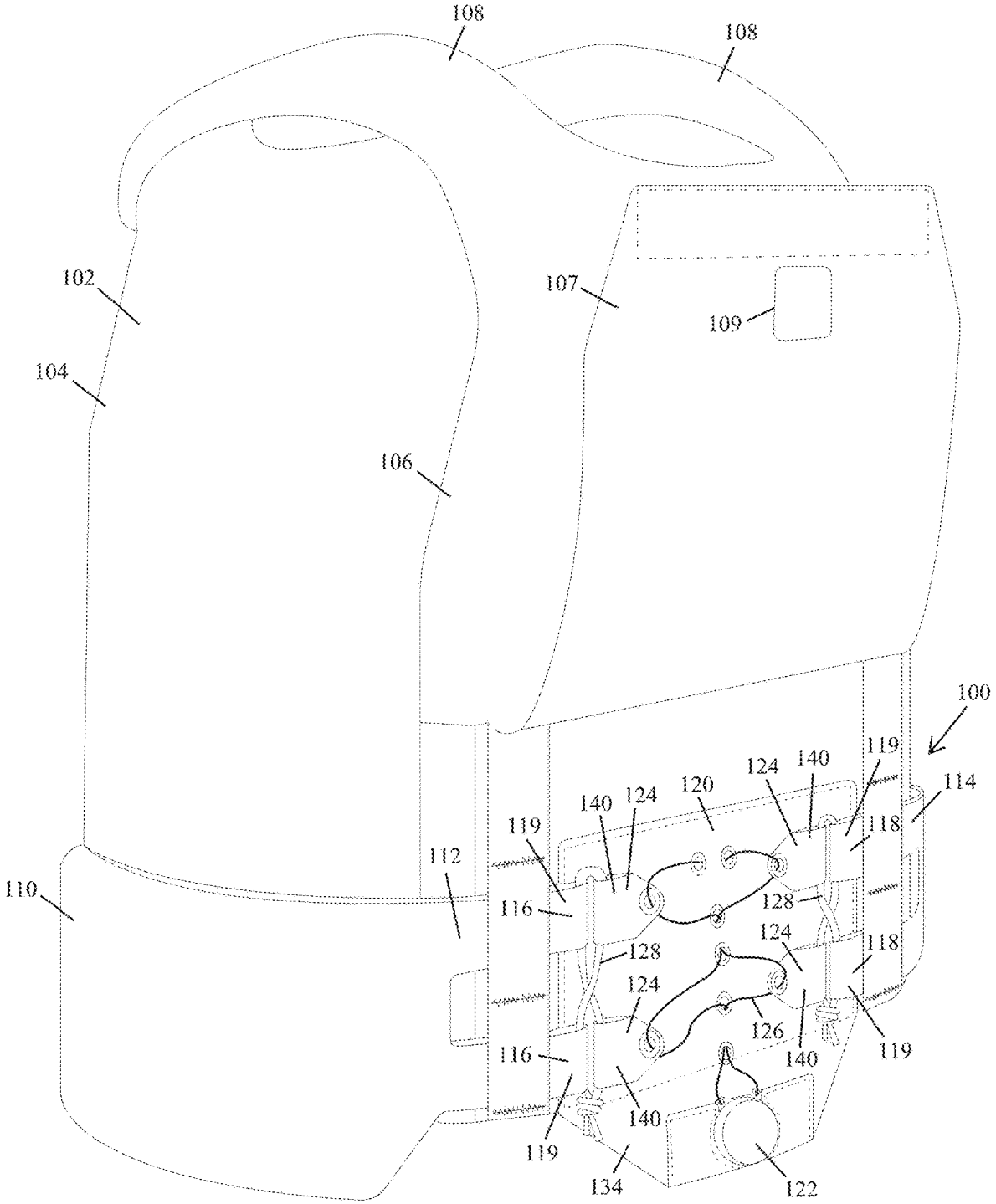
FIG. 1 illustrates a plate carrier equipped with a cummerbund tensioning system according to the principles of the present disclosure.

FIG. 1 illustrates a plate carrier 102 equipped with a cummerbund tensioning system 100. The example plate carrier 102 comprises front and back panel sections 104, 106 connected by shoulder straps 108 and a cummerbund 110. The cummerbund tensioning system 100 is configured to join opposing ends 112, 114 of the cummerbund 110 to the back panel section 106 of the plate carrier 102 and to adjust the fit of the cummerbund 110.

Figure 2:
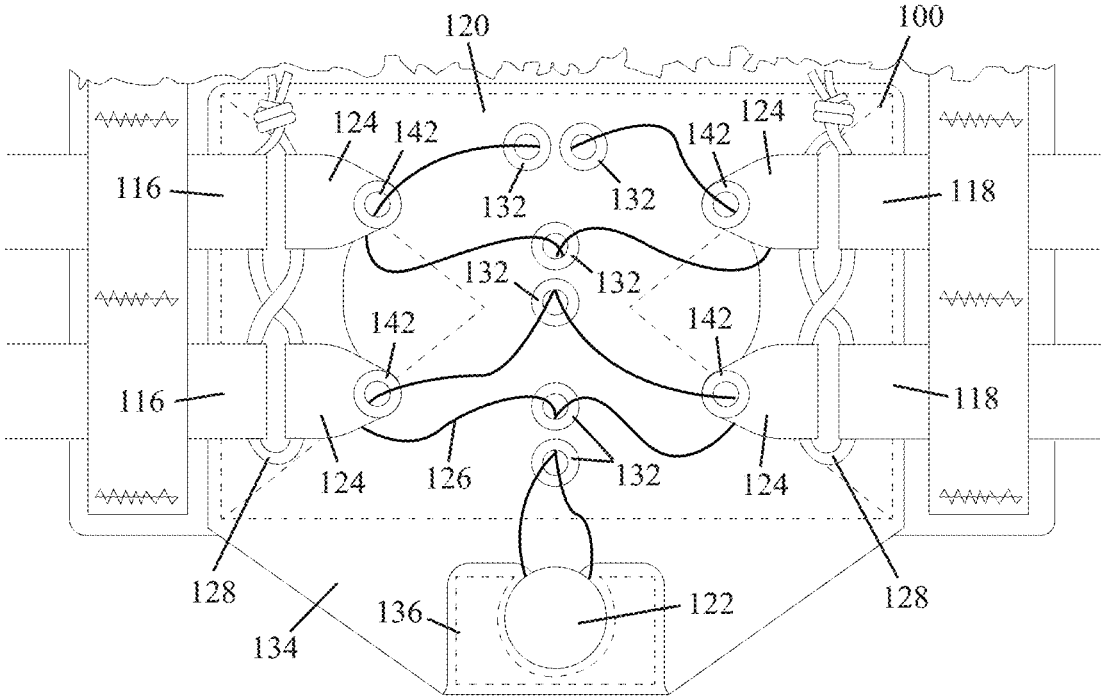
FIG. 2 illustrates the cummerbund tensioning system shown in FIG. 1.

As shown in FIG. 2, the cummerbund tensioning system 100 comprises a mounting panel 120, a tensioning device 122, a plurality of adapters 124, and a lace 126 operably connecting the tensioning device 122 to both the mounting panel 120 and the plurality of adapters 124. The adapters 124, in conjunction with the lace 126, are configured to join opposing ends 112, 114 of the cummerbund 110 to the mounting panel 120. The tensioning device 122 is configured to adjust the fit of the cummerbund 110 by gathering the lace 126, which draws the opposing ends 112, 114 closer together and tightens the cummerbund 110 around the wearer. Additionally, the tensioning device 122 is configured to release the lace 126, thereby loosening the cummerbund 110.

Figure 3:
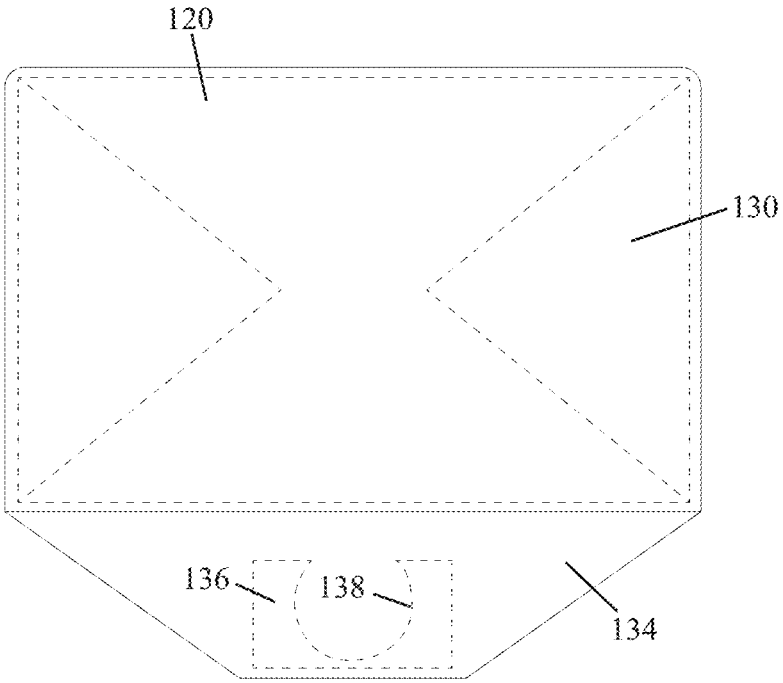
FIG. 3 illustrates the back side of the mounting panel of the cummerbund tensioning system shown in FIG. 2.
Figure 4:
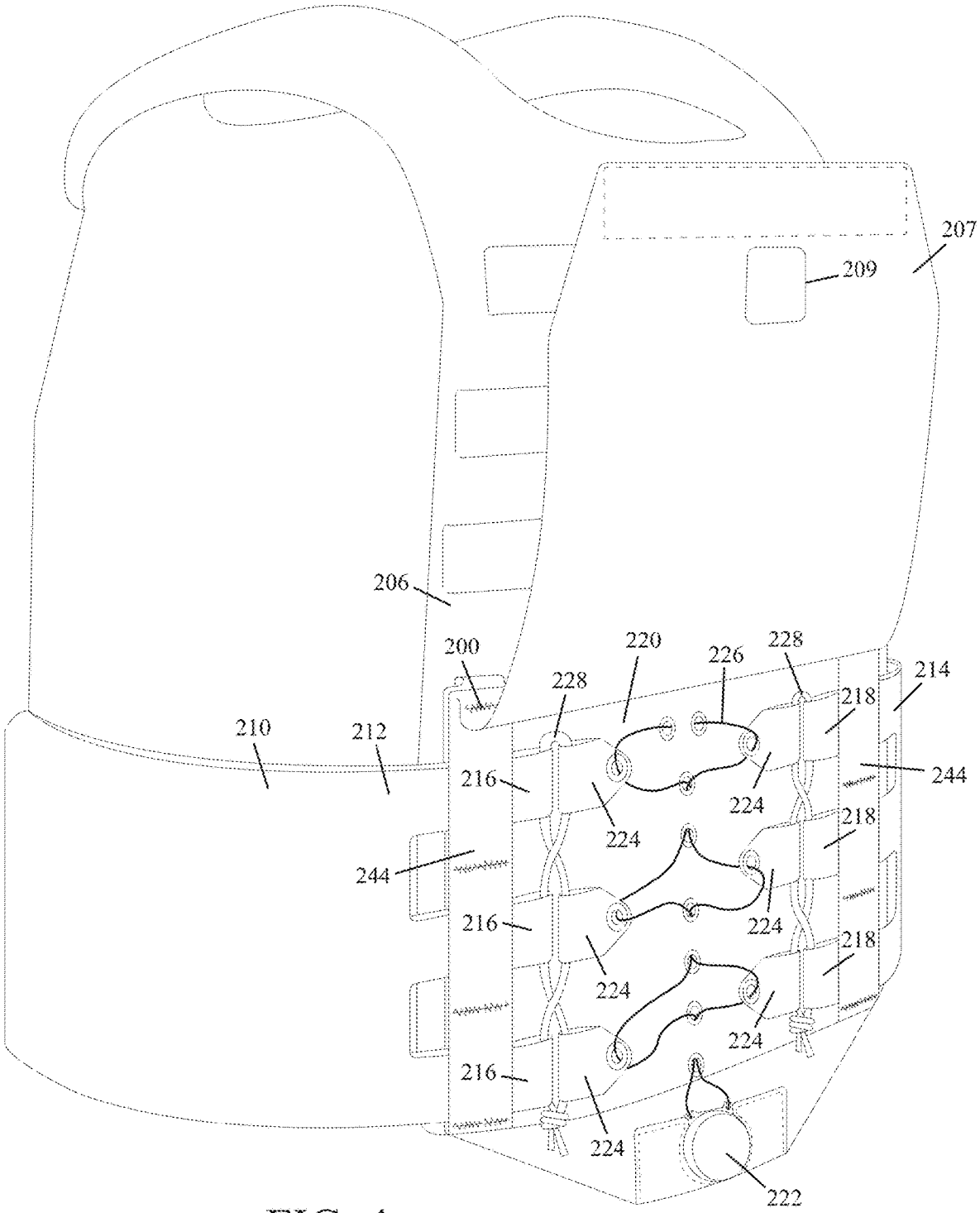
FIG. 4 illustrates a plate carrier equipped with another cummerbund tensioning system according to the principles of the present disclosure.

The mounting panel 120 is configured for attachment to the back panel section 106 of the plate carrier 102. In the preferred embodiment, the mounting panel 120 is attached to the back panel section 106 by hook-and-loop fasteners 130 (see, e.g., FIG. 3). The mounting panel 120 includes a plurality of spaced-apart openings 132 positioned to route the lace 126. In particular, the openings 132 are positioned so that gathering the lace 126 draws the adapters 124 closer together, thereby pulling the opposing ends 112, 114 of the cummerbund 110 closer together. Preferably, the openings 132 are formed by metal grommets through which the lace 126 may be passed. Each grommet defining a circular opening that allows access to an interior compartment of the mounting panel 120.

The tensioning device 122 is attached to a portion of the mounting panel 120 and used to tension the lace 126 in order to adjust the fit of the cummerbund 110. In the preferred embodiment, the tensioning device 122 is attached to a portion 134 of the mounting panel 120 hanging below a bottom edge of the back panel section 106 of the plate carrier 102 (see, e.g., FIG. 2). The tensioning device 122 is held in position by a mount 136, shown in broken lines, that includes a cutout 138 configured to receive and retain the tensioning device 122 in position. The mount 136 is made of a rigid plastic and sewn into the mounting panel 120. The example tensioning device 122 is a reel or dial based mechanism that is the same as, or similar to, the reel described in U.S. Pat. No. 9,101,181, entitled "REEL-BASED LACING SYSTEM", which is incorporated herein by reference in its entirety.

The plurality of adapters 124 are used to connect the ends 112, 114 of the cummerbund 110 to the cummerbund tensioning system 100. In the preferred embodiment, an adapter 124 is secured to each band, labeled 116 or 118, extending from an end 112, 114 of the cummerbund 110. The example cummerbund 110 includes two bands, labeled 116 or 118, extending from each of the opposing ends 112, 114. Each adapter 124 comprises a strip of material folded to form a loop 140, with an opening 142 extending through the overlapping ends of the strip of material. Preferably, the opening 142 is formed by a metal grommet through which the lace 126 may be passed. The folded strip of material may be a laminate fabric (e.g., laminated Cordura nylon), a thermal plastic material (e.g., Tegris thermoplastic composite), or any other suitable material.

In the illustrated embodiment, an elastic cord 128 (e.g., shock cord) joins a pair of adapters 124 to each end 112, 114 of the cummerbund 110. More specifically, an elastic cord 128 is used to secure one adapter 124 to each of the two bands 116, 118 on one end 112, 114 of the cummerbund 110. Each elastic cord 128 extends through an opening defined by the loop 140 of each adapter 124 and an opening defined by a loop 119 on the end of each band 116, 118 (see, e.g., FIGS. 1 and 2). The use of elastic cords 128 allows for a better fit of the cummerbund 110 and enhances comfort during movement. In some implementations, not shown, a nonelastic cord may be used instead.

The lace 126 operably couples the adapters 124 to the tensioning device 122, and thereby also couples the opposing ends 112, 114 of the cummerbund 110, to the same tensioning device 122. More specifically, the lace 126 is routed through the openings (132 and 142) of the mounting panel 120 and the adapters 124. When tensioned, the lace 126 pulls the opposing ends 112, 114 of the cummerbund 110 toward each other to tighten the cummerbund around a wearer. The lace 126 can be a high lubricious cable or fiber with a high tensile strength. In some implementations, the lace 126 may comprise multiple strands of material woven together.

In use, the cummerbund tensioning system 100 is covered by a cover flap 107 located on the back panel section 106 of the plate carrier 102, except for the tensioning device 122, which remains accessible through an opening 109 in the cover flap 107.

FIGS. 4-7 illustrates another example implementation of a cummerbund tensioning system 200 according to the present disclosure. The cummerbund tensioning system 200, similar to the cummerbund tensioning system 100 discussed above, is configured to join opposing ends 212, 214 of a cummerbund 210, which includes three bands (labeled 216 or 218) on each of the opposing ends 212, 214. Additionally, the mounting panel 220 of the cummerbund tensioning system 200 is configured for attachment to PALS (Pouch Attachment Ladder System) webbing 211 locating on the back panel section 206 of the plate carrier 202.

Figure 5:
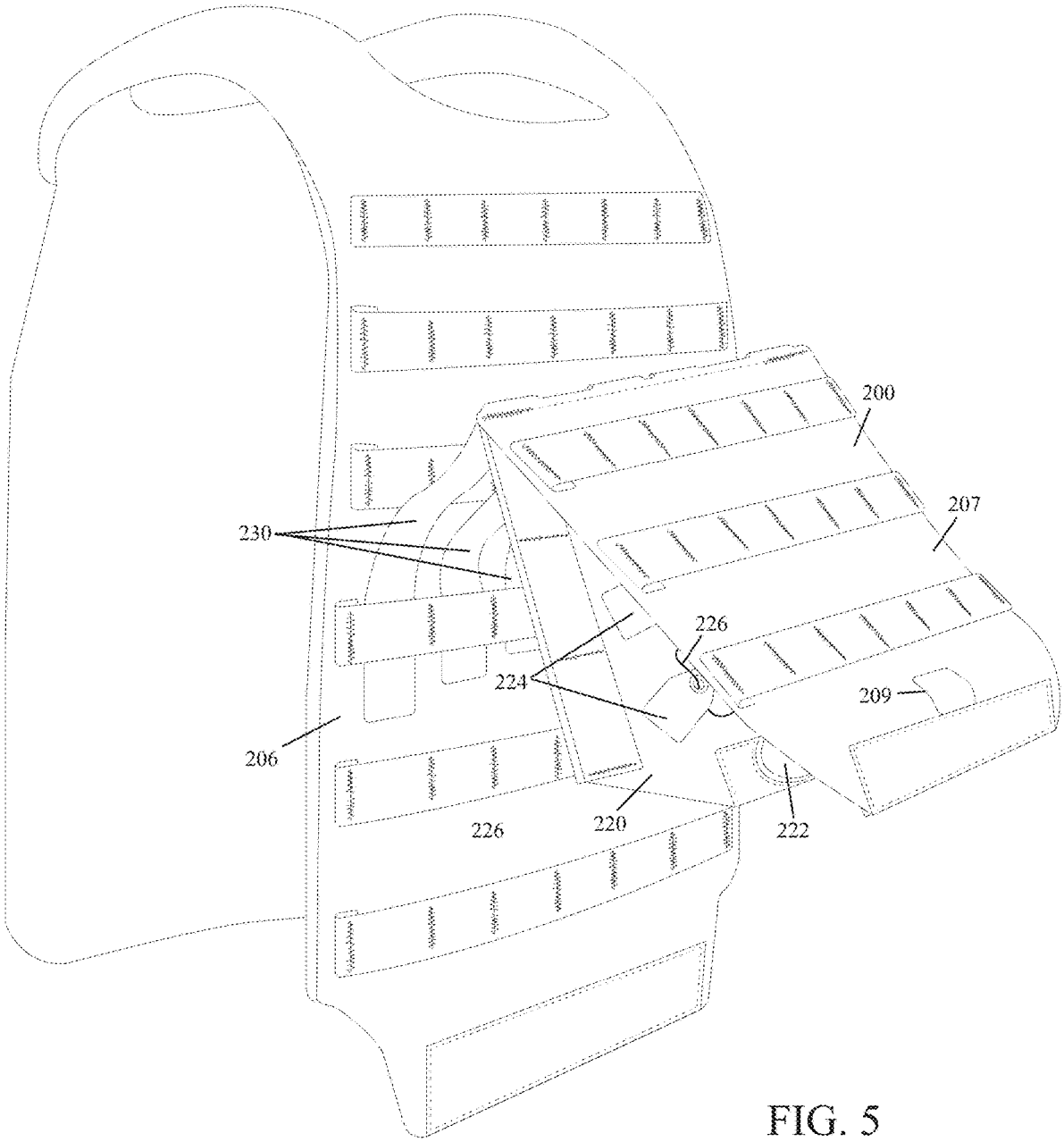
FIG. 5 illustrates the cummerbund tensioning system shown in FIG. 4 being attached to the plate carrier.
Figure 6:
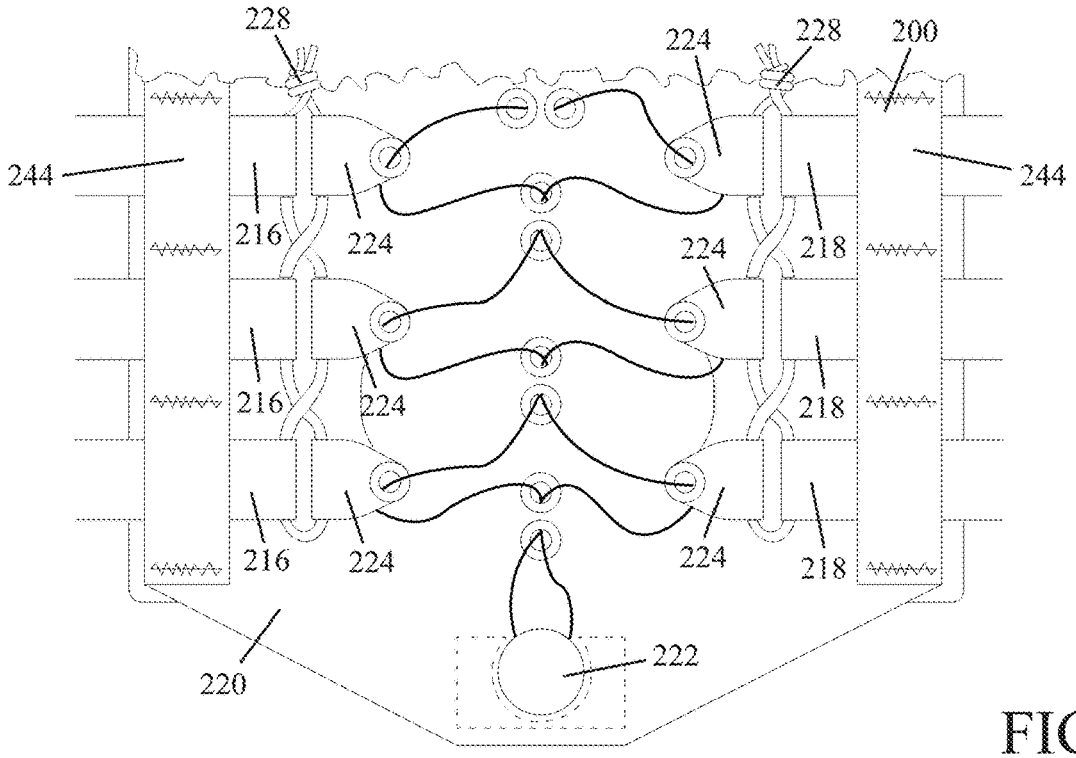
FIG. 6 illustrates the cummerbund tensioning system shown in FIG. 4.
Figure 7:
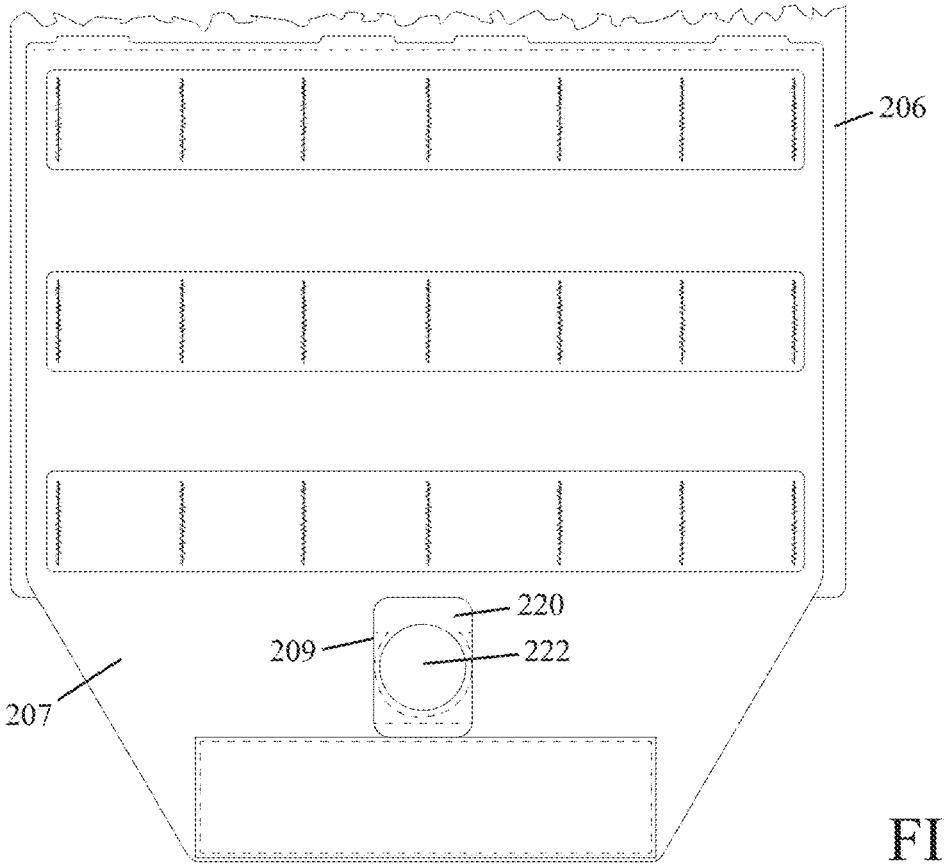
FIG. 7 illustrates the cover flap of the plate carrier covering the cummerbund tensioning system shown in FIG. 4, with the tensioning device accessible through an opening in the cover flap.

As shown best in FIG. 5, the mounting panel 220 includes webbing straps 230 used to secure the mounting panel 220 to PALS webbing. The cover flap 207 is attached to the mounting panel 220 and, as disclosed above, includes an opening 209 for the tensioning device 222. The mounting panel 220 also includes two spaced-apart vertical rows 244 of nylon webbing. Each vertical row 244 of nylon webbing is configured to guide and position the three bands 216, 218 extending from each opposing end 212, 214 of the cummerbund 210.

The tensioning device 222, plurality of adapters 224, and lace 226 are the same as, or similar to, the tensioning device 122, plurality of adapters 124, and lace 126 disclosed above. As shown, the adapters 224 are secured to the bands 216, 218 on each end 212, 214 of the cummerbund 210 by an elastic cord 228 that is the same as, or similar to, the elastic cord 128 previously disclosed.

The foregoing description of the present disclosure is intended to be illustrative; it is not intended to be exhaustive or to limit the claims to the precise forms disclosed. Those skilled in the relevant art can appreciate that many modifications and variations are possible in light of the foregoing description and associated drawings.

Reference throughout this specification to an "embodiment" or "implementation" or words of similar import means that a particular described feature, structure, or characteristic is included in at least one embodiment of the present disclosure. Thus, the phrase "in some implementations" or a phrase of similar import in various places throughout this specification does not necessarily refer to the same embodiment.

The described features, structures, or characteristics may be combined in any suitable manner in one or more embodiments. In the above description, numerous specific details are provided for a thorough understanding of embodiments of the present disclosure. One skilled in the relevant art will recognize, however, that embodiments of the present disclosure can be practiced without one or more of the specific details, or with other methods, components, materials, etc. In other instances, well-known structures, materials, or operations may not be shown or described in detail.

The invention claimed is:

1. A tensioning system for a cummerbund, the tensioning system comprising:

a mounting panel;

a tensioning device;

a plurality of adapters;

a first elastic cord;

a second elastic cord; and a lace;

wherein:

the lace operably connects the tensioning device to both the mounting panel and the plurality of adapters;

the plurality of adapters, in conjunction with the lace, are configured to join a first end and a second end opposite the first end of the cummerbund to the mounting panel;

the first elastic cord secures at least two adapters of the plurality of adapters to the first end of the cummerbund, and the second elastic cord secures at least two adapters of the plurality of adapters to the second end opposite the first end of the cummerbund; and the tensioning device is configured to adjust the fit of the cummerbund by gathering the lace, thereby drawing the first and second ends closer together and tightening the cummerbund around a wearer.

2. The tensioning system of claim 1, wherein the tensioning device is configured to release the lace, thereby loosening the cummerbund.

3. The tensioning system of claim 1, wherein each adapter includes an opening through which the lace is routed.

4. The tensioning system of claim 1, wherein each of the first elastic cord and the second elastic cord extends through an opening defined by each adapter and through an opening defined by a loop on a corresponding band of the cummerbund.

5. The tensioning system of claim 1, wherein the tensioning device comprises a reel-based mechanism.

6. A tensioning system for a cummerbund, the tensioning system comprising:

a mounting panel;

a tensioning device;

a plurality of adapters;

a first elastic cord;

a second elastic cord; and a lace;

wherein:

the tensioning device is attached to the mounting panel;

the mounting panel includes a plurality of spaced-apart openings positioned to route the lace;

the lace is routed through the spaced-apart openings of the mounting panel and operably connects the tensioning device to the plurality of adapters;

the plurality of adapters, in conjunction with the lace, are configured to join a first end and a second end opposite the first end of the cummerbund to the mounting panel;

the first elastic cord secures at least two adapters of the plurality of adapters to the first end of the cummerbund, and the second elastic cord secures at least two adapters of the plurality of adapters to the second end opposite the first end of the cummerbund; and the tensioning device is configured to adjust the fit of the cummerbund by gathering the lace, thereby drawing the first and second ends closer together and tightening the cummerbund around a wearer.

7. The tensioning system of claim 6, wherein the tensioning device is configured to release the lace, thereby loosening the cummerbund.

8. The tensioning system of claim 6, wherein the spaced-apart openings of the mounting panel are positioned so that gathering the lace draws the plurality of adapters closer together, thereby pulling the first and second ends of the cummerbund closer together.

9. The tensioning system of claim 8, wherein each adapter includes an opening through which the lace is routed.

10. The tensioning system of claim 6, wherein each of the first elastic cord and the second elastic cord extends through an opening defined by each adapter and through an opening defined by a loop on a corresponding band of the cummerbund.

11. The tensioning system of claim 6, wherein the spaced-apart openings of the mounting panel are formed by metal grommets.

12. The tensioning system of claim 11, wherein each metal grommet defines an opening that provides access to an interior compartment of the mounting panel.

13. A tensioning system for a cummerbund, the tensioning system comprising:

a mounting panel;

a tensioning device;

a plurality of adapters;

a first elastic cord a second elastic cord; and a lace;

wherein:

the tensioning device is attached to the mounting panel;

the mounting panel is configured for attachment to a back panel section of a plate carrier and includes a plurality of spaced-apart openings positioned to route the lace;

the lace is routed through the spaced-apart openings of the mounting panel and operably connects the tensioning device to the plurality of adapters;

the plurality of adapters, in conjunction with the lace, are configured to join a first end and a second end opposite the first end of the cummerbund to the mounting panel;

wherein the first elastic cord secures at least two adapters of the plurality of adapters to the first end of the cummerbund, and the second elastic cord secures at least two adapters of the plurality of adapters to the second end opposite the first end of the cummerbund; and the tensioning device is configured to adjust the fit of the cummerbund by gathering the lace, thereby drawing the first and second ends closer together and tightening the cummerbund around a wearer.

14. The tensioning system of claim 13, wherein the tensioning device is configured to release the lace, thereby loosening the cummerbund.

15. The tensioning system of claim 13, wherein the spaced-apart openings of the mounting panel are positioned so that gathering the lace draws the plurality of adapters closer together, thereby pulling the first and second ends of the cummerbund closer together.

16. The tensioning system of claim 15, wherein each adapter includes an opening through which the lace is routed.

17. The tensioning system of claim 13, wherein each of the first elastic cord and the second elastic cord extends through an opening defined by each adapter and through an opening defined by a loop on a corresponding band of the cummerbund.

18. The tensioning system of claim 13, wherein the tensioning device is attached to a portion of the mounting panel configured to hang below a bottom edge of the back panel section of the plate carrier.

* * * * *